US009394039B2

(12) United States Patent
Starbuck et al.

(10) Patent No.: US 9,394,039 B2
(45) Date of Patent: Jul. 19, 2016

(54) CONTROL SYSTEM AND CONTROL BAR FOR A TRACTION WING

(71) Applicant: Neil Pryde Limited, New Territories, Hong Kong (CN)

(72) Inventors: David Starbuck, Hong Kong (CN); Pete Cabrinha, Hong Kong (CN); Philip Sobolev, Hong Kong (CN); David Hastilow, Hong Kong (CN)

(73) Assignee: NEIL PRYDE LIMITED, New Territories, Hong Kong (CN)

( * ) Notice: Subject to any disclaimer, the term of this patent is extended or adjusted under 35 U.S.C. 154(b) by 37 days.

(21) Appl. No.: 14/192,095

(22) Filed: Feb. 27, 2014

(65) Prior Publication Data

US 2015/0014486 A1 Jan. 15, 2015

(30) Foreign Application Priority Data

Feb. 27, 2013 (HK) ..... 13102465

(51) Int. Cl.
*A63H 27/00* (2006.01)
*B63B 35/79* (2006.01)

(52) U.S. Cl.
CPC ..... *B63B 35/7979* (2013.01)

(58) Field of Classification Search
CPC ..... B63B 35/7979; B63B 35/7993; B63B 35/7976; B64C 31/06; B64C 31/01; B64C 31/00; B64C 31/028; B63H 2009/0692; B64H 9/0685
USPC ..... 244/155 A, 155 R, 4 A; 114/39.16, 39.18
See application file for complete search history.

(56) References Cited

U.S. PATENT DOCUMENTS

2006/0102794 A1* 5/2006 Quijano ..... B63B 35/7979 244/155 A
2006/0226294 A1 10/2006 Logosz et al.
2008/0035796 A1 2/2008 See et al.
2008/0067291 A1* 3/2008 Logosz ..... B63B 35/7979 244/155 A

FOREIGN PATENT DOCUMENTS

EP 1 516 810 A1 3/2005
FR 2 752 408 A1 2/1998

OTHER PUBLICATIONS

European Patent Office; Search Report in EP Patent Application No. 14 15 7072 (May 22, 2014).

* cited by examiner

*Primary Examiner* — Timothy D Collins
*Assistant Examiner* — Richard G Davis
(74) *Attorney, Agent, or Firm* — Leydig, Voit & Mayer, Ltd.

(57) ABSTRACT

A control system for a traction wing includes a control bar having first and second ends. A first fixing arm is connected to each end of the bar. Each fixing arm has a fixing point for attachment of a respective wing control line. At least one of the fixing arms is an articulated arm that is pivotally connected to its end of the bar and is pivotable between a first position defining a first effective control bar length and a second position defining a second effective control bar length.

14 Claims, 9 Drawing Sheets

CONTROL SYSTEM AND CONTROL BAR FOR A TRACTION WING

TECHNICAL FIELD

The present invention relates to control systems and to a control bar for a traction wing that is controllable in direction and angle of attack and which is may be used in sports such as kite surfing.

BACKGROUND OF THE INVENTION

A control system generally used on this type of wing comprises a rigid control bar to each end of which is fixed a "rear line", so-called for its remote or distal end being connected to the wing behind its centre of pressure, and a single central line bifurcating into two lines called "front lines" for their remote or distal ends being attached in front of the centre of pressure of the wing. The lower end of the central line is fixed to the user, as to a harness, and the bar slides along the single central line. Pivoting the bar to the left and right changes the direction of the wing, while extending and retracting the bar respectively decreases and increases the angle of attack of the wing relative to the wind, and thus regulates its power. A control system of this type is described, for instance, in FR2762583.

The length of the bar, or width of the bar if one prefers, dictates the effort and speed with which a user can turn the kite. A long bar reduces the effort required to turn the kite, and smaller movements are required of the user meaning that the kite can be turned quickly. A shorter bar requires a greater effort by the user to turn the kite, therefore more input is required to get the kite to turn, this may be desirable when performing tricks or when using a smaller kite. Many user will chose a bar length depending on their riding ability and style. It may be desirable for a ride to have a bar which can be length adjusted.

DISCLOSURE OF THE INVENTION

To this effect the invention provides a control system for a traction wing that includes a control bar having first and second ends. A first fixing arm is connected to each end of the bar. Each fixing arm has a fixing point for attachment of a respective wing control lines. At least one of the fixing arms is an articulated arm that is pivotally connected to its end of the bar and is pivotal between a first position defining a first effective control bar length and a second position defining a second effective control bar length.

In one particular aspect the invention provides a control bar for a traction wing comprising: a bar having first and second ends, a first fixing arm connected to the first end of the bar, the first fixing arm having a first fixing point for attachment of a first wing control line, a second fixing arm connected to the second end of the bar, the second fixing arm having a second fixing point for attachment of a second wing control line, wherein, at least the first fixing arm is pivotally connected to the first end of the bar and is pivotal between a first position defining a first distance between the first and second fixing points and a second position defining a second distance between the first and second fixing points. Preferably, the bar further includes a first releasable retaining means for releasable retaining the first fixing arm in the first or second positions. Preferably, the second fixing arm is pivotally connected to the second end of the bar and is pivotal between a first position defining a first distance between the first and second fixing points and a second position defining a second distance between the first and second fixing points.

In another particular aspect the invention provides a control bar for a traction wing comprising: a bar having first and second ends, a first fixing arm connected to the first end of the bar, the first fixing arm having a first fixing point for attachment of a first wing control line, a second fixing arm connected to the second end of the bar, the second fixing arm having a second fixing point for attachment of a second wing control line, wherein, the first and second fixing arms are freely pivotally connected to the respective first and second ends of the bar such that in use the first and second fixing arms can freely pivot during control of the wing.

In yet further aspects the invention provides a control system or a control bar as defined in any one of the appended claims.

Further aspects of the invention will become apparent from the following description which is given by way of example only.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

The following description is given by way of example only to illustrate the invention. It is not intended to limit the scope of use or functionality of the invention. In particular, the invention is not limited in its application to the details of construction and the arrangements of components set forth in the following description or illustrated in the accompanying drawings. The invention is capable of other embodiments and of being practiced or being carried out in various ways. Also, it is to be understood that the phraseology and terminology used is for the purpose of description and should not be regarded as limiting.

Figure 1:
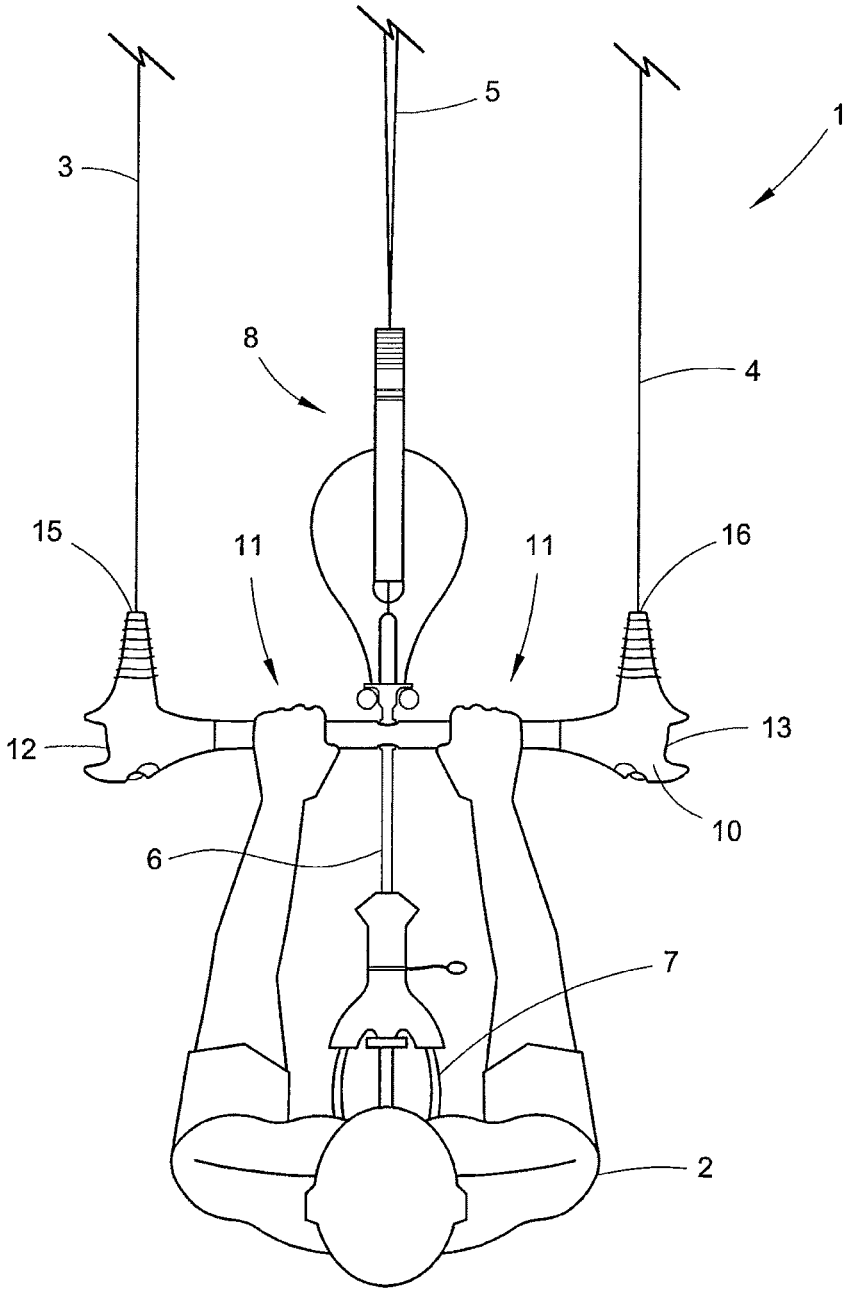
FIG. 1 is an illustration of a kite control system.

Referring to FIG. 1, a control system 1 for a traction kite or wing comprises a rigid bar 10 having control line fixing points 15, 16 at its two ends 12, 13 to which is fixed a respective kite control line 3, 4 having its remote or distal end connected to a kite (not shown) behind its centre of pressure. The bar also has at it centre between the two ends 12, 13 an aperture 14 though which a single central line 6 can pass. The signal central line 6 bifurcates into two front kite lines 5 having their remote or distal ends connected to a kite in front of its centre of pressure. The lower end of the central line 6 is fixed to the user 2, or to a harness worn by the user 2, by a loop 7. The bar 10 slides along the single central line 6. Either side of the central aperture 14 are hand grip regions 11 that are graspable by the user 2 to control the kite. Pivoting the bar 2 to the left and right changes the direction of the wing, while extending and retracting the bar along the central line 6 respectively decreases and increases the angle of attack of the wing relative to the wind, and thus regulates its power.

Referring now to FIGS. 2 through 10, at each end 12, 13 of the control bar 10 is a pivotally attached articulating fixing arm 26 having respective control line fixing apertures 31 at their remote (distal) ends 33. The drawings only illustrate details of the pivoting arm 26 arrangement at one end, say and 13, of the bar. The articulating arm arrangement at the other end, say end 12, of the bar is identical to the illustrated engagement, albeit a mirror image.

Figure 2:
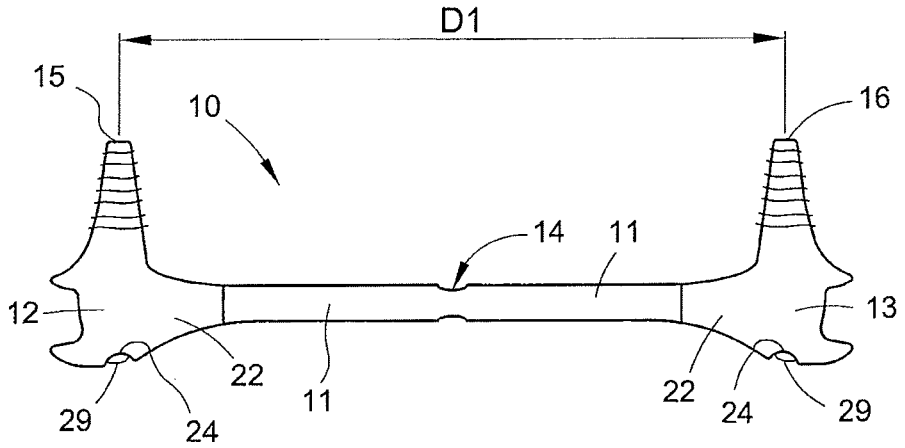
FIG. 2 illustrates an adjustable control bar configured with a first effective control bar length D1.
Figure 3:
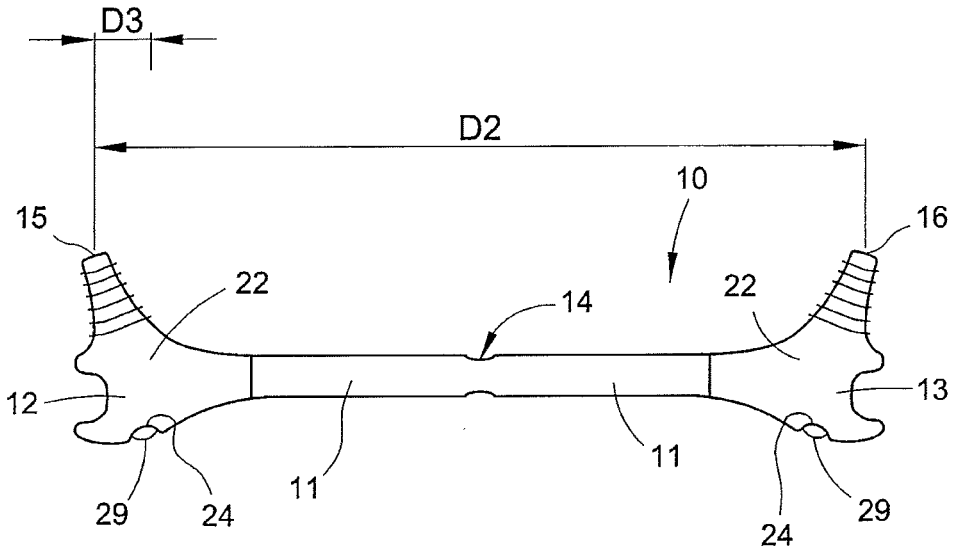
FIG. 3 illustrates the adjustable control bar configured with a second effective control bar length D2.
Figure 4:
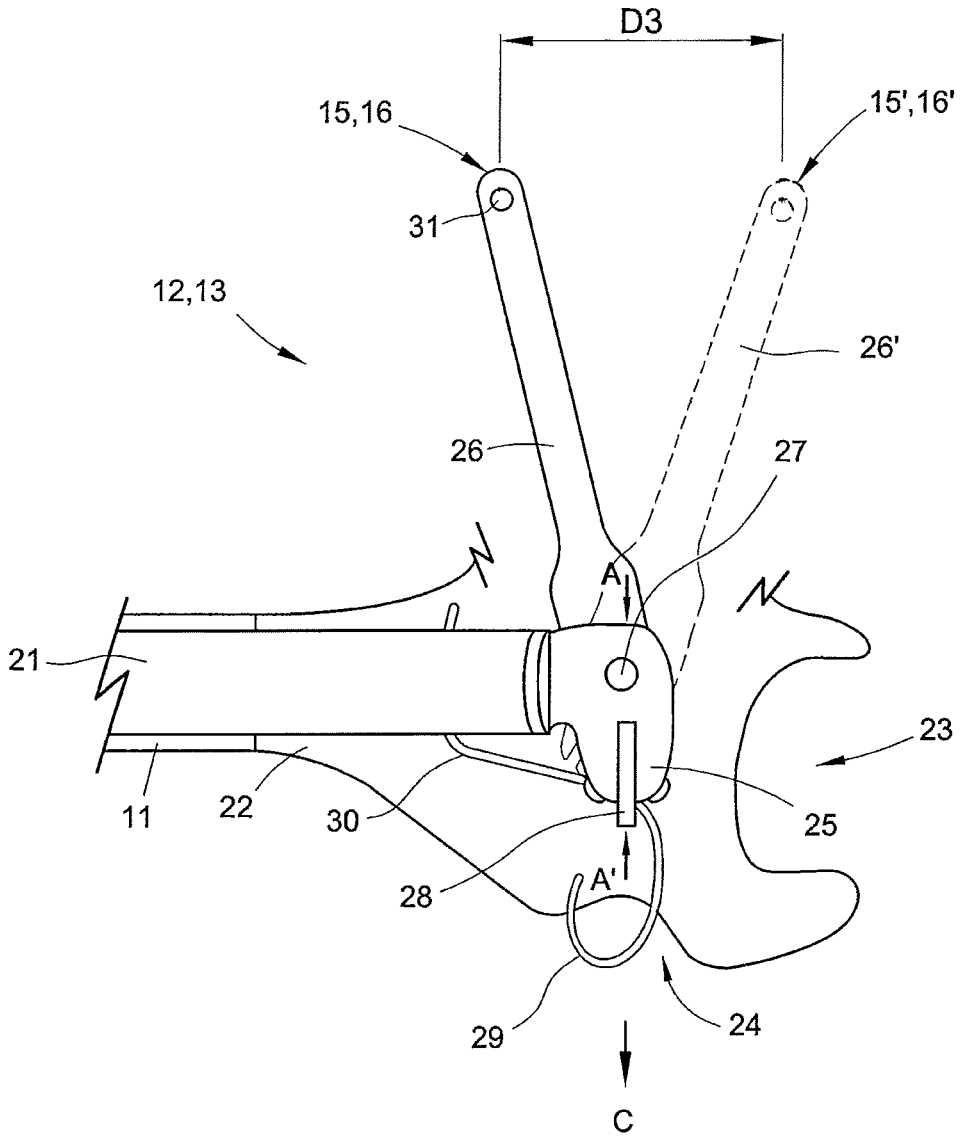
FIG. 4 illustrates an end of an adjustable control bar according to the invention.

The articulating fixing arms 26 are pivotal between respective first positions where the distal ends of the fixing arms 26 extend generally inwardly towards each other and the centre of the bar 10 forming an angle of less than 90 degrees with the bar so as to define a first distance D1 between the control line fixing points 15 and 16, and respective second positions where the distal ends of the fixing arms 26 extend generally away from each other and the centre of the bar 10 forming an angle of more than 90 degrees with the bar so as to define a second distance D2 between the control line fixing points 15 and 16. In the first pivot position, as illustrated in FIG. 2, the effective control length of the bar between the control line fixing points 15 and 16 is distance D1. In the second pivotal position, shown in FIG. 3, the effective control length of the bar between the control line fixing points 15 and 16 is distance D2 which is greater than length D1 by a third distance twice D3 (2×D3). In this way a single bar can have two effective control lengths between the control line fixing points 15 and 16.

Figure 5:
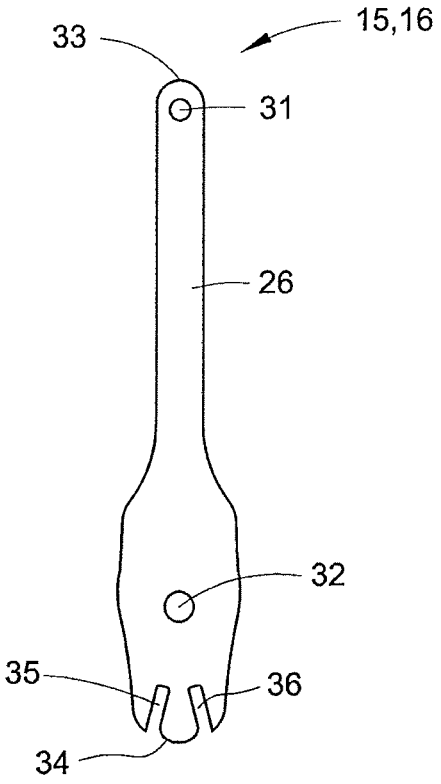
FIGS. 5-6 illustrates a fixing arm of the adjustable control bar.
Figure 6:
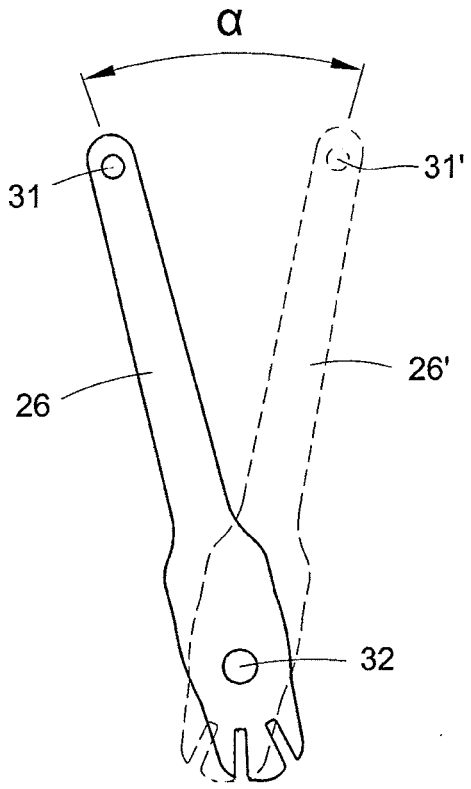
Figure 7:
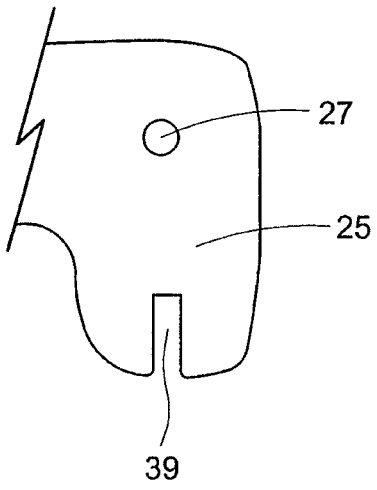
FIG. 7 is a side illustration of a fixing shoulder of the adjustable control bar.

A preferred embodiment of the pivotal fixing arms 26 is shown in FIGS. 4 to 10. The control bar comprises a bar 21 having at each of its respective ends a fixing shoulder 25. The fixing shoulder 25 has a pivot point 27 which lies generally, although not essentially, on the longitudinal centreline of the bar 21. The fixing shoulder 25 has a downwardly extending portion in which is from an elongate slot 39. The elongate slot 39 is formed along an imaginary radial line passing though the centre of the pivot 27. Turning to FIG. 5 there is shown a preferred embodiment of the fixing arms 26. The fixing arms 26 have a wider flange portion at a proximal end 34 and a thinner elongate arm portion extending from the flange portion to a distal fixing end 33. Located generally at a centre of the flange portion is an aperture 32 for pivotally engaging the fixing arm 26 about the pivot 27 of the fixing shoulder 25. At the proximal end 34 of the flange portion are two spaced apart elongate slots 35, 36 each extending along respective imaginary lines radially aligned with the centre of the pivot aperture 32. As will be appreciated by the skilled addressee the two imaginary lines along which slots 35, 36 are formed intersect at the centre of the pivot aperture 32 defining an angle alpha (α) between the lines, which is the angular distance between the first and second positions of the fixing arms 26. When a fixing arm 26 is pivotally engaged with the pivot 27 of the fixing shoulder 25 the arm 26 is pivotal through the angle alpha (α) between the first pivot position shown by the solid outline in FIGS. 4 and 6 and the second pivot position shown by the broken outline in FIGS. 4 and 6. In the first position the first elongate slot 35 of the fixing arm 26 aligns with the slot 39 in the fixing shoulder 25 and in the second pivot position the second slot 36 of the fixing arm 26 aligns with the slot 39 of the fixing shoulder 25.

Figure 9:
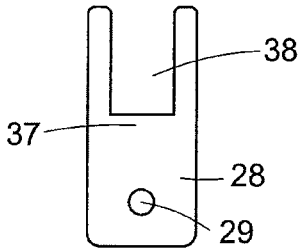
FIG. 9 illustrates a fixing tab for locking the fixing arm in position.

FIG. 9 shows a retaining tab 28 having at one end a mouth 38 which locates about the pivotally connected fixing shoulder 25 and fixing arm 26, and an aperture 29 at its second end for receiving a resilient biasing member 30. At the base of the mouth 28 is a retaining tongue 37 which engages within aligned slots 35 and 39, or 36 and 39 as the case may be, of the fixing shoulder 25 and fixing arm 26 when the arm is in the respective first or second position. When the fixing arm 26 is in the first position the slot 35 and slot 39 of the fixing shoulder 25 align and receive the tongue 37 of the retaining tab 28 to retain or lock the fixing arm 26 in the first position. If the tab is move in the direction of arrow C of FIG. 4 the tongue 37 withdraws from the slots 35, 39 and the fixing arm 26 can be pivoted through angular distance alpha (α) to the second position in which slots 36 and 39 align and wherein the tongue 37 can be received within the slots 26, 39 to retain or lock the fixing arm 26 in the second position.

Figure 12:
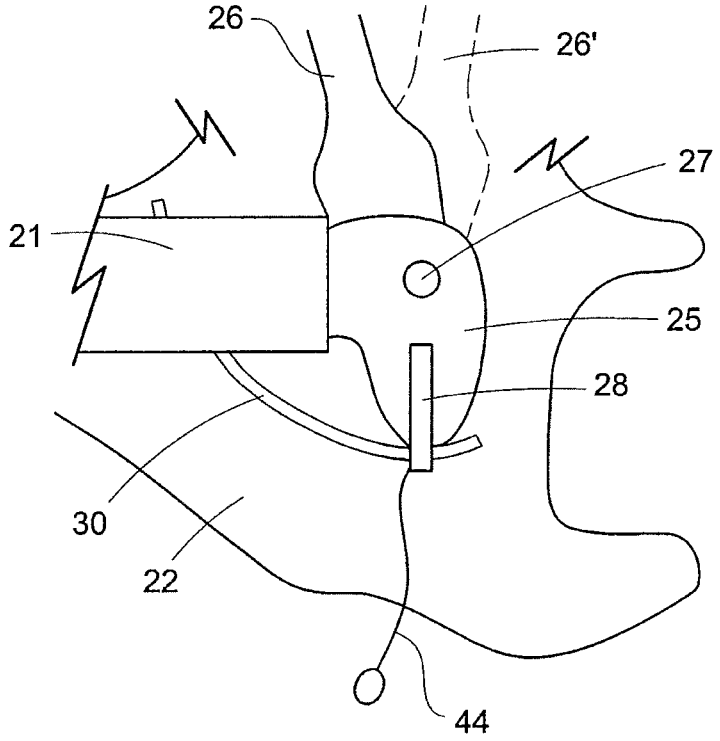
FIG. 12 illustrates a second embodiment of a release for the retaining tab.

The retaining tab 28 is biased in the locked position (that is to say with the tongue 37 engage with a respective combination of the slots 35, 36, and 39) by the resilient biasing member 30. In the preferred embodiment the resilient biasing member 30 is a spring wire which at its first end is engaged through an aperture of the bar 21 to anchor the biasing member 30 at its first end. The wire runs substantially parallel to the bar 21 and through the aperture 29 of retaining tab 28 before bending substantially away from the fixing arm 26 and forming a loop 29 at its second end. The spring wire of the biasing means 30 is tensioned to retain the retaining tab 28 with the tongue 37 within respective slots of the fixing arm 26 and fixing shoulder 25. The tongue 37 can be withdrawn from the respective slots by a user pulling the loop 29 in the direction of arrow C shown in FIG. 4 for moving the fixing arm between the first and second positions. FIG. 12 illustrates an alternative embodiment of a release for the retaining tab 28. Instead of loop 29, the resilient biasing means 30 terminates after engaging the retaining tab 28 and a line 44 engaged with the tab 28 is provided to a position outside a sheath 22. The tongue 37 can be withdrawn from the respective slots by a user pulling the line 44 in the direction of arrow C shown in FIG. 4. A knot of ferrule can be provided in the end of the line 44 to aid grip by the user.

Figure 16:
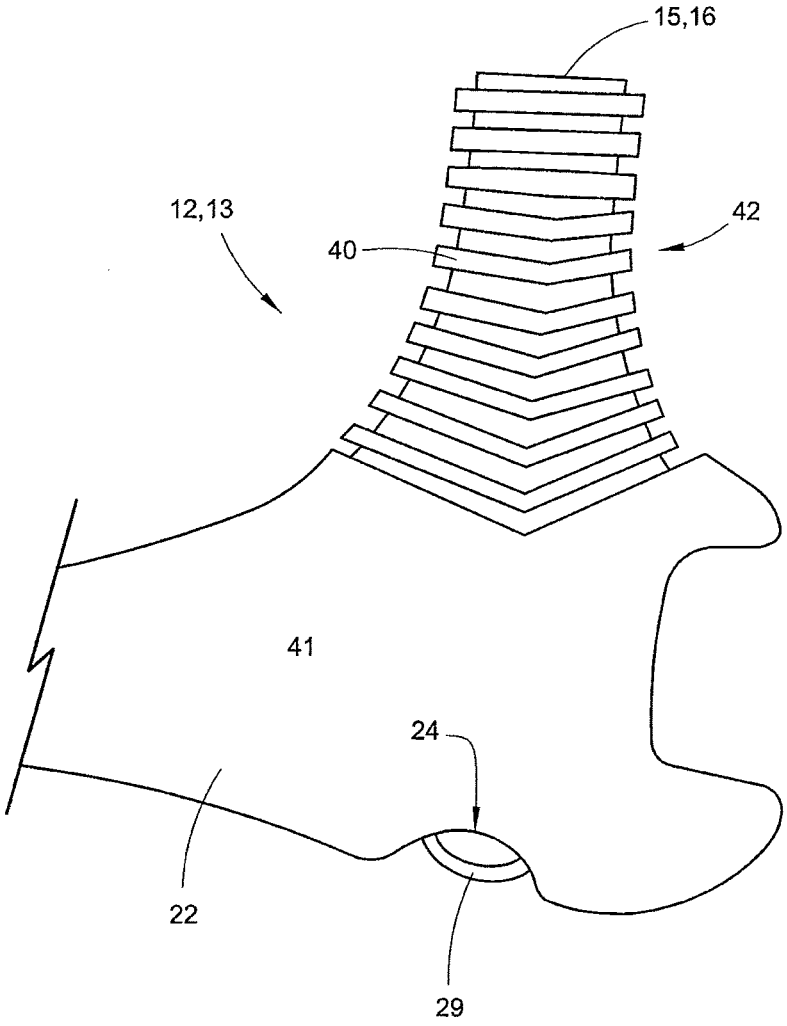
FIG. 16 illustrates an elastically deformable covering for bar ends.

The bar ends 12, 13 and fixing arms 26 are covered in an elastically deformable sheath 22 for comfort, safety and aesthetics. The sheath 22 of the bar includes first scallops 23 at the lateral ends of bar for storing attached kites lines by winding longitudinally round the bar. The sheath 22 also includes second scallops 24 on an edge adjacent each end of the bar to permit the user access to the loops 29 for releasing the retaining tabs 28 when adjusting the positions of the fixing arms 26. In FIG. 2 a portion of the sheath 22 enclosing the fixing arms is not shown for drawing clarity reasons. The full sheath 22 is shown in FIG. 16.

The fixing end 33 of the fixing arm 26 moves the third distance D3 between the first and second positions. In the preferred embodiment there is a pivotal fixing arm 26 at each end of the control bar such that the effective control bar length D2 is twice D3 longer than effective length D1 (i.e. D2=(2×

Figure 11:
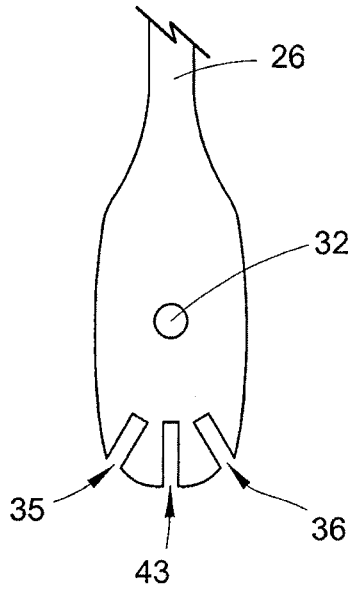
FIG. 11 illustrates an alternative embodiment of the fixing arm having three setting positions.

D3)+D1). In the above described embodiment the fixing arm 26 has two slots 35, 36 for setting two articulated positions of the arm. In other embodiments more slots may be provided for more positions, for example as illustrated in FIG. 11 third slot 43 can be provided in the proximal end of fixing arm 26 between slots 35, 36 for a third position fixing position between the first or second positions. In the third position the third slot 43 of the fixing arm aligned with slot 39 of the fixing shoulder 25 to provide a third effective control bar length between the control line fixing points 15 and 16. It should be recognised within the physical size limits of the bar and bar end any number of slots and thus fixing positions can be provided for the articulated bar end.

Figure 8:
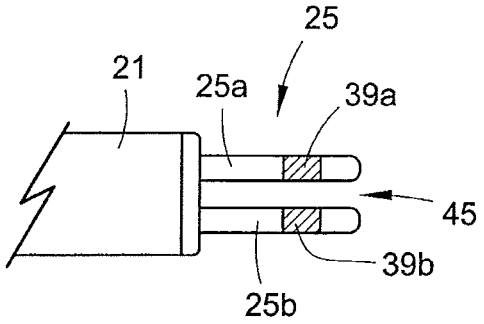
FIG. 8 is a bottom illustration of the fixing shoulder of the adjustable control bar.
Figure 10:
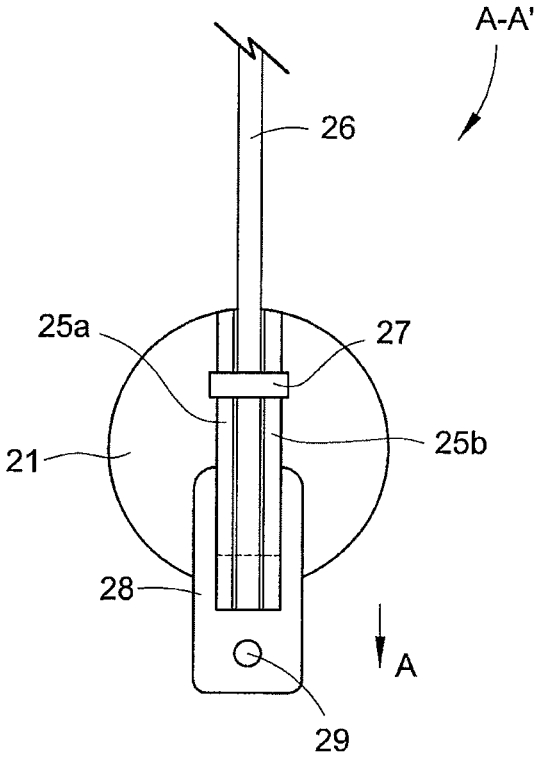
FIG. 10 illustrates a section view through A-A' of the fixing shoulder.

FIGS. 8 and 10 illustrated pivotal connection between the fixing shoulder 25 and articulated fixing arm 26. In the preferred embodiment the fixing shoulder is two identical plates 25*a*, 25*b* each have the same shape with respective slots 39*a*, 39*b* and spaced apart by a gap 45. The articulated fixing arm 26 locates within the gap 45 between the fixing shoulder plates 25*a*, 25*b*. The pivot 27 pivotally connects the fixing shoulder plates 2*a*, 25*b* and articulated fixing arm 26.

Figure 13:
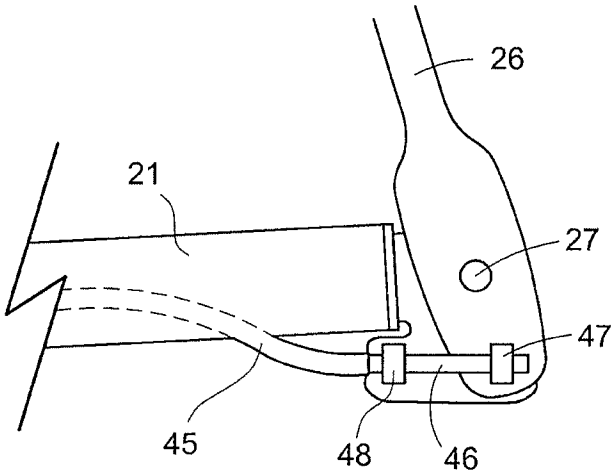
FIG. 13 illustrates a second embodiment of an end of an adjustable control bar according to the invention.

The above described embodiment has a fixed number of positions for fixing arm 26. In a second embodiment of an adjustable control bar illustrated in FIG. 13, the articulated arm position is controlled via a cable 45 extending from a control position proximate the centre of the bar. The control cable 45 passes through the bar 21 and exits through an aperture in the bar 21 proximate the bar end. The cable sheath engages with a flange 48 connected with the fixing shoulder. The centre member 46 of the cable is engaged with an engagement member 47 pivotally attached to the proximal end of the articulate fixing arm 26. The centre member 46 of the cable may be a sliding cable within the sheath operated by a lever adjacent the centre of the control bar 10. Operating the lever to extend or retract the distal end of the cable 46 moved the articulating arm 26 thus changing the control length between the control line fixing points 15 and 16. The cable may be moved in steps for discrete arm positions and thus discrete control length between the control line fixing points 15 and 16. Alternatively the cable can be continually adjustable for a continuous range of control lengths between longest and shortest limits. The type of lever used to manipulate the cable may be, for example, any of the type of shiftier mechanisms used in the bicycle industry. Such a shifter could be located at the centre of the control bar 10 with a respective cable 45 extending to either end of the bar for moving the respective articulated arms 26 at either end of the control bar 10.

Figure 14:
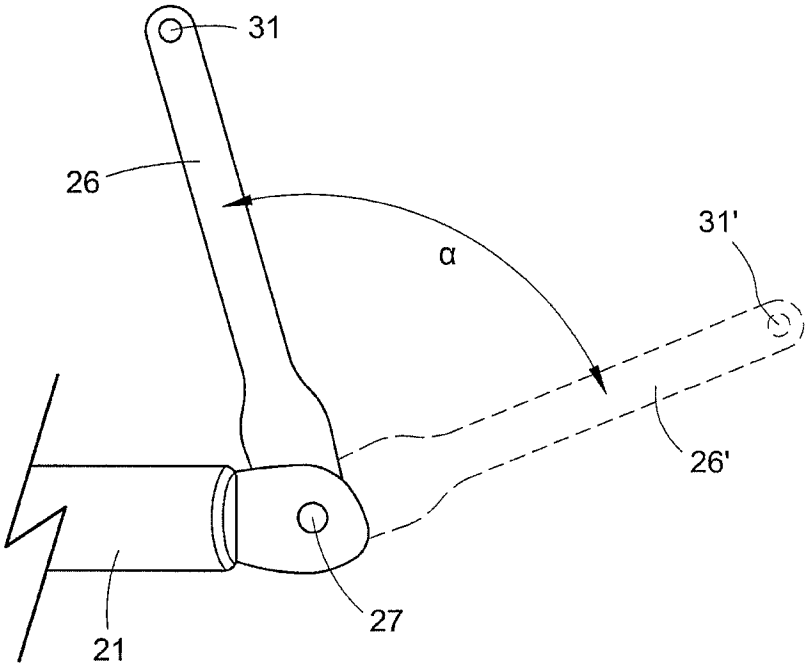
FIG. 14 illustrates a third embodiment of an end of an adjustable control bar according to the invention.
Figure 15:
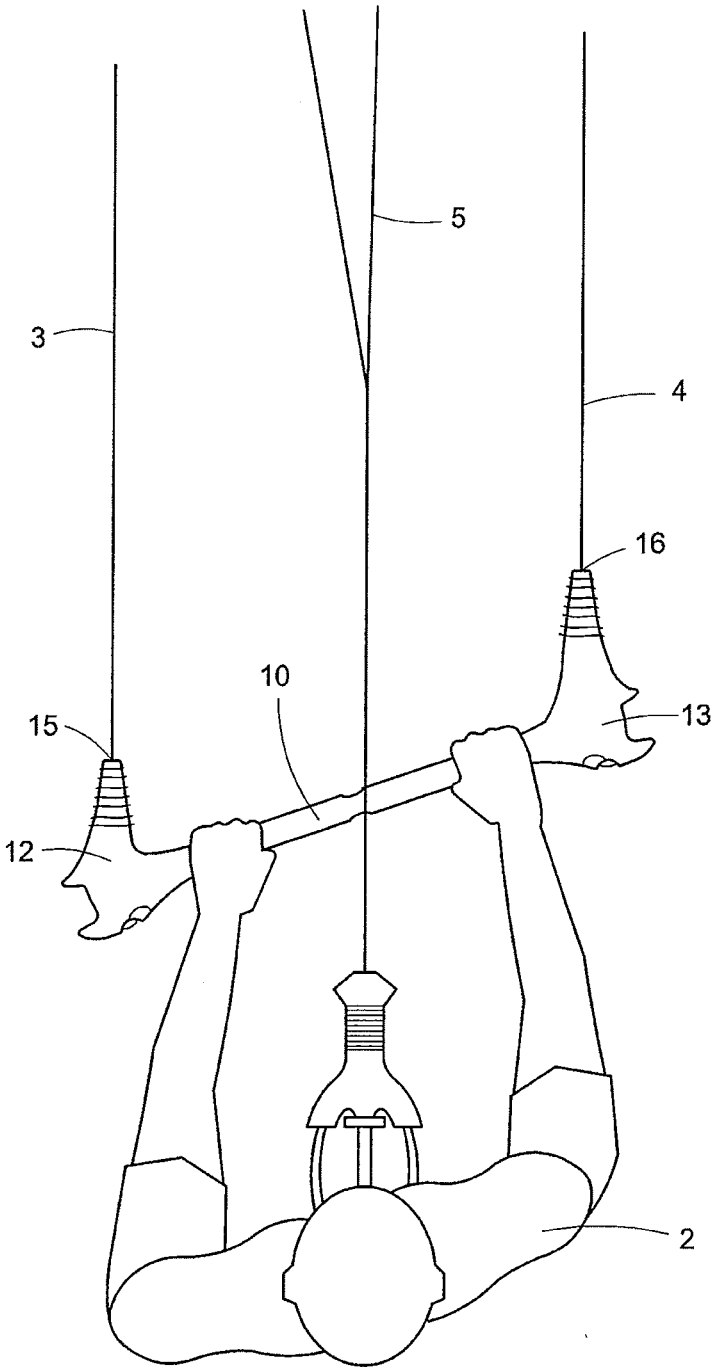
FIG. 15 illustrates turning of a kite using the second embodiment of the adjustable control bar.

Alternatively, the centre member 46 of the cable can be a rotating member within the sheath with the distal end of the cable 46 formed with screw thread engaged with a threaded bore in the arm engagement member 47. The centre member 46 of the cable may be driven by a collar about a with screw thread engaged with a threaded bore in the arm engagement member 47 position of the control bar which is turned by the user to rotate the centre member 46 of the cable thus driving the engagement member 47 long the threaded distal end of the cable and changing the position of the arm 26. In a third embodiment of an adjustable control bar illustrated in FIGS. 14 and 15 one or both fixing arms 26 can be pivotally free floating without retaining or locking means such that the fixing arms 26 pivot freely with movement of the bar 10 or kite. In such an embodiment the arms are free to pivot oppositely during turning of the kite. As the kite is turned the control line on the inside of the turn is pulled-in (or sheeted-in), while the control line on the outside of the turn is paid-out (or sheeted-out). The fixing arm on the inside of the turn will pivot inwardly towards the centre of the bar helping sheet-in the inside control line, while at the same time the opposite fixing arm on the outside of the turn will pivot outwardly away from the centre of the bar helping sheet-out the outside line. In FIG. 15 the rider is turning the kite to the left in direction of arrow B by sheeting in on left control line 3 and sheeting out on right control line 4. The pivoting fixing arm at the left end 12 of the bar pivots inwardly to help sheet-in line 3 while the pivoting fixing arm at the right end 13 of the bar 10 pivots outwardly to help sheet-out the right control line 4.

Referring to FIG. 16 the bar ends 12, 13 and fixing arms 26 are covered in an elastically deformable sheath 22 for comfort, safety, ergonomics aesthetics. Preferably the sheath 22 is made of an elastomer or soft EVA, or similar, elastically deformable foam to maintain a smooth ergonomic form when the fixing arm is in either of the first or second positions. The sheath 22 comprises a bar end portion 41 enclosing the end of the bar 21, fixing shoulder 25 and pivot 27, and an orthogonal flexible boot portion 42 extending from the bar end portion to the fixing points 15, 16 and enclosing the elongate portion of the fixing arm 26. The flexible boot portion 42 has a plurality of circumferential ribs 40 encircling the boot 42 and spaced longitudinally from the bar end portion 41 and the fixing points 15, 16. The ribs 40 form a corrugated outer surface on the flexible boot portion 42 which maintains a smooth ergonomic form when the boot 42 bends with the fixing arm 26 between the first or second positions. The central hand grippable regions 11 of the bar are covered in a more resilient elastically deformable foam or rubber material to provide grip and cushioning for the user. The covering in the hand grippable regions 11 of the bar is preferably elastically deformable, but is stiffer (less flexibility or elastically deformable) than the sheath 22 of the bar ends 12, 13 so as to provide a firm, but cushioned, feel and greater durability. One measure used to indicate the stiffness of an elastic material is elastic-modulus or Young's modulus. Materials with a higher modulus value are less elastic. The covering in the hand grippable regions 11 of the bar a higher modulus value than the sheath 22.

Aspects of the present invention have been described by way of example only and it should be appreciated that modifications and additions may be made thereto without departing from the scope thereof.

The invention claimed is:

1. A control bar for a traction wing comprising:

a bar having first and second ends, a fixing shoulder fixed to the first end of the bar, a first fixing arm connected to the fixing shoulder, the first fixing arm having a first fixing point for attachment of a first wing control line, and a second fixing arm connected to the second end of the bar, the second fixing arm having a second fixing point for attachment of a second wing control line, wherein the first fixing arm is pivotally connected at a pivot to the fixing shoulder and is pivotable between a first position, defining a first distance between the first and second fixing points, and a second position, defining a second distance between the first and second fixing points.

2. The control bar of claim 1 further including releasable retaining means for releasably retaining the first fixing arm in the first and second positions.

3. The control bar of claim 1, wherein the fixing shoulder includes a first slot, the first fixing arm includes second and third slots, the first, second, and third slots are radially orientated with respect to the pivot, the first and second slots align in the first position, the first and third slots align in the second position, and the releasable retaining means comprises a tongue engageable within respective aligned slots, of the first, second, and third slots, for retaining the first fixing arm in one of the respective first and second positions.

4. The control bar of claim 3 further including an elastically deformable retaining member for biasing the tongue in a retaining position with respect to the first fixing arm.

5. The control bar of claim 4, wherein the retaining member comprises a retaining spring member having a first end engaged with the bar, and a second end forming a user engageable release handle for engaging with the tongue between the first and second ends of the spring member.

6. The control bar of claim 1, wherein at least one of the first and second fixing arms is enclosed in an elastically deformable boot having a plurality of circumferential ribs encircling the boot.

7. The control bar of claim 1, wherein the control bar is enclosed in a sheath, the sheath comprises a first elastically deformable portion enclosing the bar and a second elastically deformable portion enclosing the first and second fixing arms, and the second elastically deformable portion has a lower elastic modulus value than the first elastically deformable portion.

8. The control bar of claim 1, wherein the second fixing arm is pivotally connected with the second end of the bar, and is pivotable between a third position defining a third distance between the first and second fixing points, and a fourth position defining a fourth distance between the first and second fixing points.

9. The control bar of claim 1, wherein the second fixing arm is pivotally connected to the second end of the bar and is pivotable between a third position defining a third distance between the first and second fixing points and a fourth position defining a fourth distance between the first and second fixing points.

10. A control system for a traction wing comprising:

a bar having first and second ends and an aperture between the first and second ends, a first fixing shoulder fixed to the first end of the bar, a central line engaged or engageable through the aperture, the central line having a user attachment member at a first end of the central line and bifurcating into kite front lines at a second end of the central line, a first fixing arm connected to the first fixing shoulder, the first fixing arm having a first fixing point engaged or engageable with a first wing control line, and a second fixing arm connected to the second end of the bar, wherein the second fixing arm has a second fixing point engaged or engageable with a second wing control line, and the first fixing arm is pivotally connected at a pivot to the first fixing shoulder and is pivotable between a first position, defining a first distance between the first and second fixing points, and a second position, defining a second distance between the first and second fixing points.

11. The control system of claim 10, further comprising a second fixing shoulder fixed to the second end of the bar, wherein the second fixing arm is pivotally connected with the second fixing shoulder, and is pivotable between a third position defining a third distance between the first and second fixing points, and a fourth position defining a fourth distance between the first and second fixing points.

12. A control bar for a traction wing comprising:

a bar having first and second ends, a first fixing shoulder fixed to the first end of the bar, a second fixing shoulder fixed to the second end of the bar, a first fixing arm connected to the first fixing shoulder, the first fixing arm having a first fixing point for attachment of a first wing control line, and a second fixing arm connected to the second fixing shoulder, the second fixing arm having a second fixing point for attachment of a second wing control line, wherein the first and second fixing arms are freely pivotally connected to the respective first and second fixing shoulders such that, in use, the first and second fixing arms can freely pivot during control of the wing.

13. A control bar for a traction wing comprising:

a bar having first and second ends, a first fixing arm connected to the first end of the bar, the first fixing arm having a first fixing point for attachment of a first wing control line, and a second fixing arm connected to the second end of the bar, the second fixing arm having a second fixing point for attachment of a second wing control line, wherein at least the first fixing arm is pivotally connected to the first end of the bar and is pivotable between a first position, defining a first distance between the first and second fixing points, and a second position, defining a second distance between the first and second fixing points, and at least one of the first and second fixing arms is enclosed in an elastically deformable boot having a plurality of circumferential ribs encircling the boot.

14. A control bar for a traction wing comprising:

a bar having first and second ends, a first fixing arm connected to the first end of the bar, the first fixing arm having a first fixing point for attachment of a first wing control line, and a second fixing arm connected to the second end of the bar, the second fixing arm having a second fixing point for attachment of a second wing control line, wherein at least the first fixing arm is pivotally connected to the first end of the bar and is pivotable between a first position, defining a first distance between the first and second fixing points, and a second position, defining a second distance between the first and second fixing points, the control bar is enclosed in a sheath, the sheath comprises a first elastically deformable portion enclosing the bar and a second elastically deformable portion enclosing the first and second fixing arms, and the second elastically deformable portion has a lower elastic modulus value than the first elastically deformable portion.

* * * * *